US010995522B2

(12) United States Patent
Derman

(10) Patent No.: US 10,995,522 B2
(45) Date of Patent: May 4, 2021

(54) PADLOCK SECURITY

(71) Applicant: Jay S. Derman, Carlsbad, CA (US)

(72) Inventor: Jay S. Derman, Carlsbad, CA (US)

( * ) Notice: Subject to any disclaimer, the term of this patent is extended or adjusted under 35 U.S.C. 154(b) by 0 days.

(21) Appl. No.: 16/658,014

(22) Filed: Oct. 18, 2019

(65) Prior Publication Data

US 2021/0010298 A1 Jan. 14, 2021

Related U.S. Application Data

(60) Provisional application No. 62/873,229, filed on Jul. 12, 2019.

(51) Int. Cl.
*E05B 67/38* (2006.01)

(52) U.S. Cl.
CPC ..... *E05B 67/38* (2013.01); *E05B 2067/386* (2013.01)

(58) Field of Classification Search
CPC ..... E05B 2067/386; E05B 67/38
USPC ..... 70/54–56, 416, 419, 423, 424, 427, 428
See application file for complete search history.

(56) References Cited

U.S. PATENT DOCUMENTS 3,559,429 A * 2/1971 Hermann ..... E05B 67/38 70/85
3,751,948 A * 8/1973 Klein ..... E05B 67/38 70/55
4,286,445 A * 9/1981 Sills ..... E05B 17/002 70/455
4,576,022 A * 3/1986 Gamble ..... E05B 67/38 70/417
4,686,840 A * 8/1987 McCarroll ..... E05B 17/14 70/454
4,760,720 A * 8/1988 Grille ..... E05B 67/38 70/417
4,781,043 A * 11/1988 Loeffler ..... E05B 67/38 70/417
4,905,486 A * 3/1990 Appelbaum ..... E05B 67/38 70/417
5,146,771 A * 9/1992 Loughlin ..... E05B 67/38 70/417
5,477,710 A * 12/1995 Stefanutti ..... E05B 67/38 70/417
5,704,231 A * 1/1998 Heald ..... E05B 17/002 70/424
5,743,118 A * 4/1998 Anderson ..... E05B 13/002 292/205
6,305,198 B1 * 10/2001 Chastain ..... E05B 67/28 70/40

(Continued)

*Primary Examiner* — Suzanne L Barrett
(74) *Attorney, Agent, or Firm* — Bryan Fibel

(57) ABSTRACT

An enclosure for improving padlock security is provided. The enclosure includes a sleeve component that has openings at the left and right for receiving the padlock, cutouts at the top to access the shackle holes and a key slot at the bottom for accessing the padlock. The sleeve component containing the padlock is inserted into a tubular component. The tubular component has an opening at the bottom for receiving the sleeve component and padlock, one or more stoppers, capable of contacting the body of the padlock preventing further insertion of the padlock, while allowing the shackle to continue past, cutouts on the front and back sides of the enclosure beginning at the stoppers and proceeding upward and an opening at the top for accessing the shackle.

11 Claims, 14 Drawing Sheets

(56) References Cited

U.S. PATENT DOCUMENTS

| | | | | |
|---|---|---|---|---|
| 6,467,316 | B1 * | 10/2002 | Chen | E05B 17/002 70/416 |
| 6,684,668 | B1 * | 2/2004 | Hsueh Lee | E05B 67/02 70/312 |
| 7,380,425 | B2 * | 6/2008 | Elliott | E05B 67/02 70/38 R |
| 7,581,423 | B2 * | 9/2009 | Brojanac | E05B 17/002 70/423 |
| D711,724 | S * | 8/2014 | Newchurch | D8/346 |
| 2005/0155396 | A1 * | 7/2005 | Taljaard | E05B 39/02 70/56 |
| 2006/0162402 | A1 * | 7/2006 | Elliot | E05B 67/38 70/56 |
| 2012/0180535 | A1 * | 7/2012 | Dorste | E05B 67/38 70/56 |

* cited by examiner

PADLOCK SECURITY

CROSS REFERENCE TO RELATED APPLICATIONS

This application is a non-provisional that claims priority from provisional U.S. patent application No. 62/873,229 filed on Jul. 12, 2019.

FIELD OF THE INVENTION

Embodiments of the invention generally relate to padlocks. Specifically, embodiments of the invention relate to an enclosure that protects and limits access to the top and bottom of a padlock.

BACKGROUND OF THE INVENTION

A conventional padlock consists of a lock body, a shackle (commonly U shaped) operatively locked in or unlocked from the lock body, and a key-operated locking device formed in the lock body for operatively unlocking the shackle from the padlock by using a key. A padlock, if provided with a key-operated locking mechanism therein, should be unlocked only by a key.

Lock picking is the practice of unlocking a lock by manipulating the components of the lock device without the key. This is generally done by accessing the keyhole with various lock picking tools, such as torque and tension tools or a rake, but can also include bobby pins, safety pins, and paperclips. In the modern era, with so much information available to the public, more and more individuals are learning how to pick a lock with new and improved methods. The Lock Picking Lawyer, an internet personality, regularly shows the ease at which locks can be picked and that virtually no lock is pick proof. Other online resources provide information on how to pick locks with tools as common as bobby pins and paperclips.

The purpose of a lock is to prevent unauthorized persons from gaining access to any area which has been closed and locked. Locks range from securing the side gate of a person's yard to something as serious as the trigger lock on a person's gun from access by an intruder or a child. A parent or guardian may want to prevent a child or teenager from accessing items like a lock include a laptop, legal drugs, money. However, a child or teenager is now very capable of picking a lock. Since lock picking runs afoul of this purpose, there is a need for new methods to thwart lock picking.

SUMMARY

The purpose of a lock is to prevent unauthorized persons from gaining access to any area which has been closed and locked. However, more and more individuals are learning how to pick a lock with new and improved methods. Various online resources provide information on how to pick locks with tools as common as bobby pins and paperclips. The primary purpose and benefit of the disclosed invention is to improve the security provided by a padlock by limiting access to the padlock, most specifically the keyhole, thereby making lock picking more difficult or impossible. The disclosed invention makes a padlock more secure which can have wide ranging benefits from protecting personal property from theft to life saving benefits such as protecting a trigger lock on a handgun.

An enclosure for protect a padlock having a body, a shackle and a keyhole is provided. The enclosure includes a sleeve component that has openings at the left and right for receiving the padlock, cutouts at the top to access the shackle holes and a key slot at the bottom for accessing the padlock. The sleeve component containing the padlock is inserted into a tubular component. The tubular component has an opening at the bottom for receiving the sleeve component and padlock, one or more stoppers, capable of contacting the body of the padlock preventing further insertion of the padlock, while allowing the shackle to continue past, cutouts on the front and back sides of the enclosure beginning at the stoppers and proceeding upward and an opening at the top for accessing the shackle.

The sleeve component can additionally have a securement mechanism at the top to prevent the padlock from falling through the opening at the bottom of the tubular component. The cutouts on the tubular component can asymmetrically cut to allow for a swinging shackle to swing outward. The sleeve component can additionally have a neodymium magnet internally affixed to the bottom. The key slot on the sleeve component can be made to rotate. The heights of the tubular and sleeve component can be made such that the distance between bottom of the padlock and bottom of the enclosure creates a storage compartment within the enclosure below the padlock.

BRIEF DESCRIPTION OF THE DRAWINGS

The accompanying drawings taken in conjunction with the detailed description will assist in making the advantages and aspects of the disclosure more apparent.

DETAILED DESCRIPTION

Figure 1:
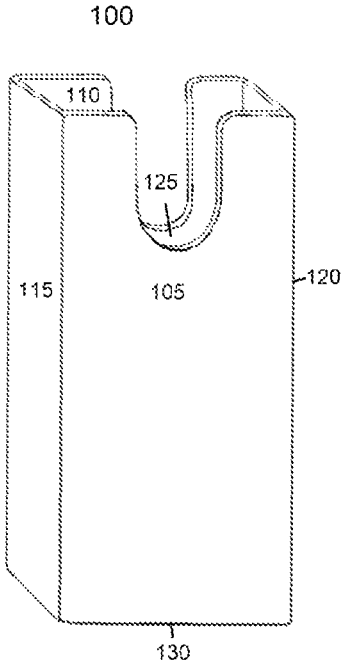
FIG. 1 is a perspective view of an outer tube component of an enclosure embodiment.

Reference will now be made in detail to the present embodiments discussed herein, illustrated in the accompanying drawings. The embodiments are described below to explain the disclosed invention by referring to the Figures using like numerals. It will nevertheless be understood that no limitation of the scope is thereby intended, such alterations and further modifications in the illustrated invention, and such further applications of the principles as illustrated therein being contemplated as would normally occur to one skilled in the art to which the embodiments relate.

A padlock security enclosure that protects and limits access to the keyhole on the bottom of a padlock is provided. The enclosure, in the preferred embodiment, comprises two components, though each component may be used separately. The first component is an outer tube having an open bottom, such that a padlock can be inserted into the enclosure. The padlock is inserted into the enclosure until it encounters one or more stoppers that come in contact with the body of the lock preventing any further insertion. The shackle is accessible through the opening at the top of the enclosure such that when it is secured to an object, such as a chain or latch, the lock cannot fall through the bottom of the enclosure. The enclosure is taller than the padlock, such that when fully inserted, the enclosure extends beyond the bottom of the lock preventing and limiting access to the keyhole at the bottom of the lock. In the preferred embodiment, parts of the enclosure extend beyond the top of the lock preventing and limiting access to the shackle. The second component is an inner sleeve having openings on the side whereby the lock body is inserted sideways into the sleeve. This sleeve component of the enclosure covers the keyhole limiting access to the keyhole only by a key slot. In the preferred embodiment, the padlock is first inserted into the inner sleeve, which is then inserted into the outer tube. The components can be used separately or in combination to protect a padlock. Further, this disclosure contemplates the use of the inventive principles discussed herein to improve padlocks.

The primary purpose and benefit of the disclosed invention is to improve the security provided by a padlock. This is done by limiting access to the padlock, most specifically the keyhole, thereby making lock picking more difficult or impossible. Other benefits with the disclosed enclosure can include protecting the lock and shackle from physical damage by bludgeoning or cutting. Locks vary in the tools and means required to successfully pick them, and the enclosure, by additionally hiding the make and model of the lock from view, makes it more difficult to determine how best to pick the lock. The disclosed invention makes a padlock more secure which can have wide ranging benefits from protecting personal property from theft to life saving benefits such as protecting a trigger lock on a handgun. Some countries take measures to improve their border security and this disclosed invention offers security options to block picking to keyed padlocks.

The disclosed invention is meant to protect a conventional padlock having a lock body, a shackle (commonly U shaped) operatively locked in or unlocked from the lock body, and a key-operated locking device formed in the lock body for operatively unlocking the shackle from the padlock by using a key. A shackle can be a stationary shackle that completely detaches from the lock body or a swinging shackle that detaches on one side and swings away from the lock body. The keyhole is located at the bottom of the padlock. The enclosure can be customized to work with a variety of locks, and this specification describes an enclosure that is sized and configured to work with the appropriate sized lock.

As illustrated in FIG. 1, a perspective view of the first outer tube component 100 of a padlock enclosure embodiment is provided. The enclosure component can be made of a variety of materials, though a strong metal that is not easily cut, broken, or drilled into is preferred. The outer tube component has 4 sides described as front 105, back 110, left 115 and right 120, and openings described as top 125 and bottom 130. The padlock is inserted in to the opening 130 at the bottom of the enclosure until it reaches a stopper that comes in contact with the body of the padlock and prevents further insertion.

Figure 2:
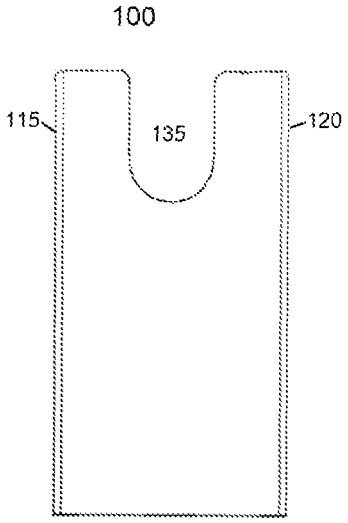
FIG. 2 is a front view of an outer tube component of an enclosure embodiment.

As depicted in FIG. 2, a view of the front of the first outer tube component 100 of the enclosure embodiment is provided. The enclosure component is rectangular shaped with a cut out section 135 on both the front and back allowing access to the shackle for the purpose of securing the lock. Such a cutout appears on the front and back side of the enclosure, at or above the stoppers and proceeding upward to the top of opening. The sides 115, 120 of the enclosure prevent inappropriate access to the shackle, such as attempts to bludgeon or cut the shackle.

Figure 3:
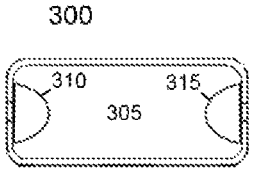
FIG. 3 is a bottom view of an outer tube component of an enclosure embodiment.

As depicted in FIG. 3, a view of the bottom of the first outer tube component 300 of the enclosure embodiment is provided. The bottom opening 305 allows for the insertion of the padlock. In the depicted embodiment, the stoppers 310, 315 are 2 screws or bolts that have been attached to the interior walls of the enclosure. A lock will be inserted until it encounters the screws preventing any further insertion. This invention contemplates other stoppers 310, 315 whereby the body of the padlock is stopped from any further insertion, such stoppers that include but are not limited to weldings on the inside of the enclosure, rivets driven into the enclosure from the outside, and dents, narrowings, or otherwise inward bent portions of the enclosure. The stopper must only prevent further insertion of the lock by contacting the lock body, while still allowing the shackle to continue past the stopper.

Figure 4:
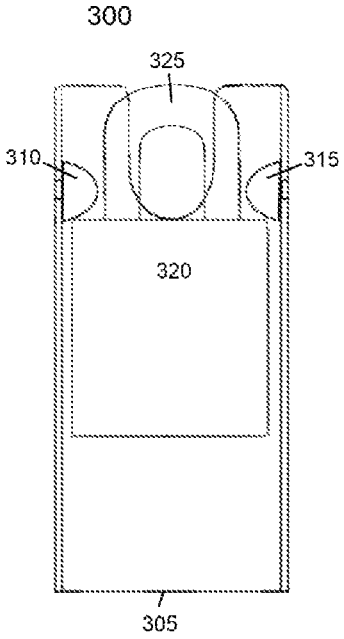
FIG. 4 is a vertical slice of the front of an outer tube component of an enclosure embodiment with padlock.

As illustrated in FIG. 4, a vertical slice of the front of the first outer tube component 300 of the enclosure embodiment with padlock inserted, is provided in order to show the padlock inside of the enclosure. The padlock 320 is inserted into the enclosure through an opening 305 in the bottom of the enclosure, the shackle 320 inserted first, followed by the body 325 of the lock. The hole 305 in the bottom of the enclosure should be slightly larger than base of the body 325 of the padlock to allow for padlock to be inserted comfortably while not being able to rotate within the enclosure. The padlock is inserted until the lock body encounters one or more stoppers 310, 315 that prevent any further insertion. The narrower shackle 320 is able to continue past the stoppers 310, 315 where it is aligned and accessible for the purpose of latching to an object. Once latched, the padlock will not be able to fall out the bottom of the enclosure. In some embodiments, a screw or similar securement mechanism can be inserted into the enclosure near the bottom in order to catch the padlock and prevent it from falling out the bottom of the enclosure, when it is unlocked.

Figure 5:
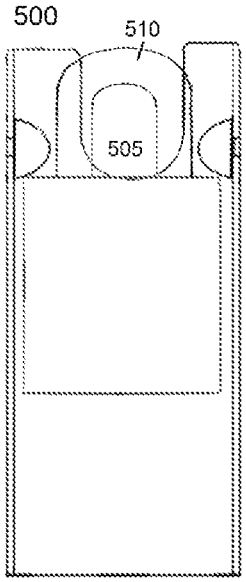
FIG. 5 is a vertical slice of the front of an outer tube component of an enclosure embodiment with padlock.

As illustrated in FIG. 5, a vertical slice of the front of the first outer tube component 500 of an alternative enclosure embodiment with padlock inserted, is provided in order to show the padlock inside of the enclosure. In the depicted embodiment, the cutout section 505 of the enclosure allowing access to the shackle is not symmetrical allowing for a swinging shackle 510.

A swinging shackle has room to swing outward when the padlock is unlocked.

Figure 6:
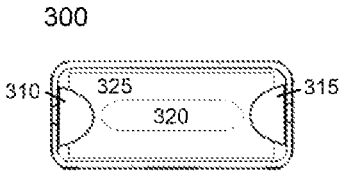
FIG. 6 is a top view of an outer tube component of an enclosure embodiment with padlock.

As illustrated in FIG. 6, a top view of the first outer tube component 300 of an enclosure embodiment with padlock inserted, is provided. As depicted, the stoppers 310, 315 have prevented the padlock body 325 from passing through the enclosure. However, the narrower shackle 320 is able to pass between the stoppers 605, 610 allowing for it to be accessed for latching.

The enclosure can vary in how tall it is, and the drawings in no way limit the size of the enclosure contemplated by this disclosure. The taller the enclosure is, the further the padlock is from the bottom of the enclosure, thus increasing the difficult of accessing the lock. The key must be able to access the lock from the bottom of the enclosure through a length of tube. This length ultimately requires a key, made longer by extending the handle, or requires a tool, such as a wand or forceps that is able to grasp the key to access the keyhole of the padlock. While an owner of the enclosure and padlock would invariably carry, have access to, or have knowledge of the whereabouts of such a key (an owner knows when they intend to open a lock), it would be less likely that a lock picker would carry tools of the necessary length.

Figure 7:
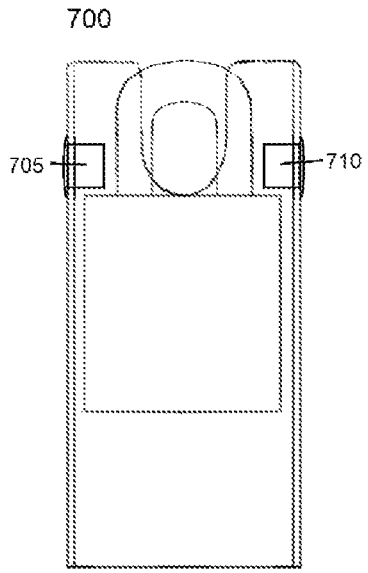
FIG. 7 is a vertical slice of the front of an outer tube component of an enclosure embodiment with padlock.
Figure 8:
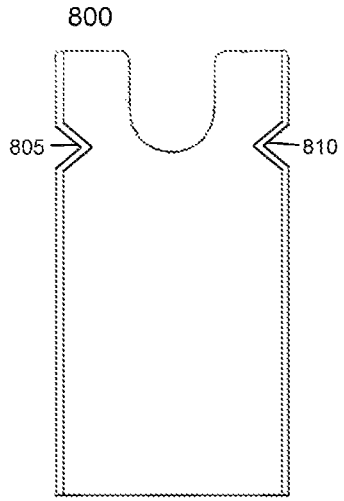
FIG. 8 is a front view of an outer tube component of an enclosure embodiment.

FIG. 7 illustrates a vertical slice of the front of the first outer tube component 700 of an alternative enclosure embodiment where a rivets are driven into the enclosure from the outside to create the stoppers 705, 710. FIG. 8 illustrates a view of the front of the first outer tube component 800 of an alternative enclosure embodiment where the left and right side walls of the enclosure have been bent inward to create the stoppers 805, 810. These figures show, by way of example, alternative stoppers that prevent further insertion of the lock by contacting the lock body, while still allowing the shackle to continue past the stopper.

Figure 9:
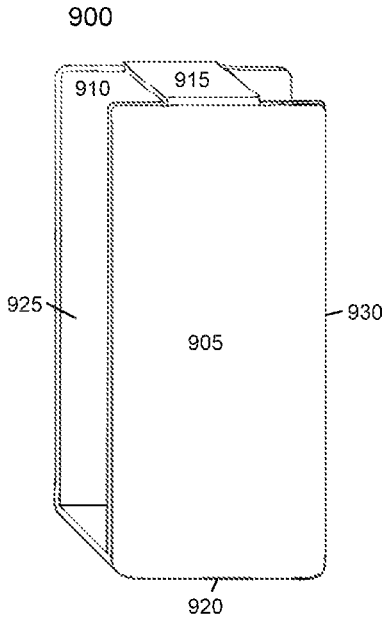
FIG. 9 is a perspective view of an inner sleeve component of an enclosure embodiment.

As illustrated in FIG. 9, a perspective view of the second inner sleeve component 900 of a padlock enclosure embodiment is provided. The enclosure component can be made of a variety of materials, though a strong metal that is not easily cut, broken, or drilled into is preferred. The inner sleeve component has 4 sides described as front 905, back 910, top 915, and bottom 920, and openings described as left 925 and right 930. The padlock is inserted in to the opening at either the left of right opening of the enclosure. The top 915 of the sleeve has cutouts so that the top is small enough to fit between the shackle legs of a padlock. In alternative embodiments the top is a complete side with circular cutouts specifically configured to the size of the shackle legs of the padlock.

Figure 10:
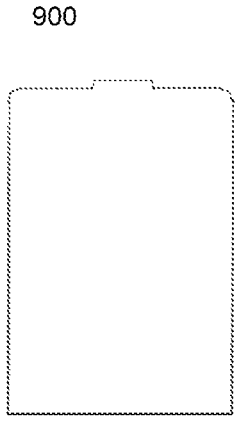
FIG. 10 is a front view of inner sleeve component of an enclosure embodiment.

As depicted in FIG. 10, a view of the front of the second inner sleeve component 900 of the enclosure embodiment is provided. The enclosure component is large enough to contain the entirety of the lock in the preferred embodiment.

Figure 11:
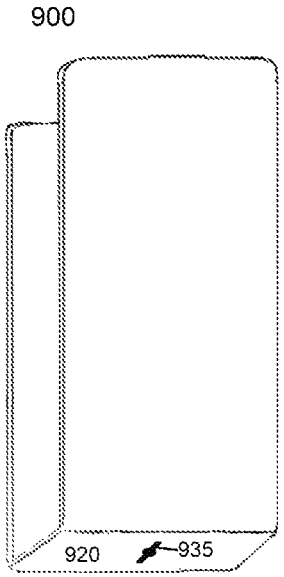
FIG. 11 is a perspective view of an inner sleeve component of an enclosure embodiment.

As illustrate in FIG. 11, a perspective view of the second inner sleeve component 900 of a padlock enclosure embodiment is provided. The bottom side 920 of the enclosure prevents access to the keyhole of the padlock, except by a key slot 935. This prevents a person from being able to access the keyhole of a padlock with their picking tools.

Figure 12:
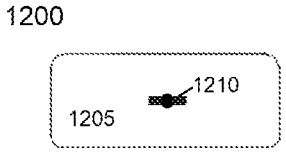
FIG. 12 is a bottom view of inner sleeve component of an enclosure embodiment.
Figure 13:
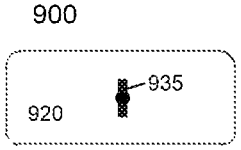
FIG. 13 is a bottom view of an inner sleeve component of an enclosure embodiment.

As depicted in FIGS. 12 and 13, views of the bottom of the second inner sleeve component 1200, 900 of the enclosure embodiment is provided. The bottom side 1205, 920 of the enclosure prevents access to the keyhole of the padlock, except by a key slot 1210, 935. The drawings show alternative embodiments where the key slot 1210, 935 can be configured to be horizontal or vertical. This can be done to match the keyhole on the padlock that the enclosure is protecting. Alternatively, in some embodiments, the key slot is configured to be at a 90 degree perpendicular to the keyhole on the padlock.

Figure 14:
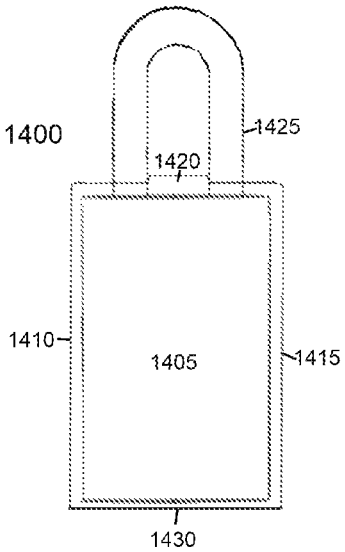
FIG. 14 is a vertical slice of the front of an inner sleeve component of an enclosure embodiment with padlock.

As depicted in FIG. 14, a vertical slice of the front of the second inner sleeve component 1400 of the enclosure embodiment with padlock inserted, is provided in order to show the padlock inside of the enclosure. The padlock 1405 is inserted through the opening at either the left 1410 of right side 1415 of the enclosure. The padlock is positioned such that the top 1420 of the inner sleeve component fits between the padlock shackle legs 1425. This occurs naturally with a padlock having a swinging shackle, where the padlock is inserted into the inner sleeve component until the shackle contacts the top 1420 of the sleeve component. The lock is then secured in the enclosure when it is latched. The bottom 1430 of the enclosure protects the keyhole from access except by the key slot. Additionally, the bottom of the enclosure obscures any view of the padlock and padlock keyhole, forcing a person attempting to pick the padlock to do so blindly.

Figure 15:
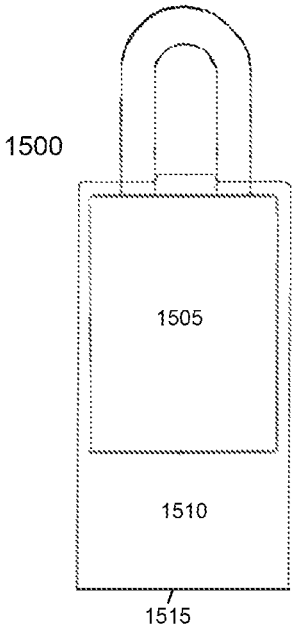
FIG. 15 is a vertical slice of the front of an inner sleeve component of an enclosure embodiment with padlock.

As depicted in FIG. 15, a vertical slice of the front of the second inner sleeve component 1500 of an alternative enclosure embodiment with padlock inserted, is provided in order to show the padlock inside of the enclosure. In the alternative embodiment, the inner sleeve component is significantly taller than the padlock 1505, such that there is empty space 1510 between the bottom of the padlock and the bottom of the enclosure. The taller the enclosure is, the further the padlock 1505 is from the bottom 1515 of the enclosure, thus increasing the difficulty of accessing the lock. The bottom of the enclosure protects the keyhole from access except by the key slot. This distance ultimately requires a key that is able to pass through the key slot and continue to the keyhole of the padlock. While an owner of the enclosure and padlock would invariably carry such a key, it would be less likely that a lock picker would carry tools of the necessary length. This disclosure contemplates key slots of varying size and depth and keys of varying size and strength. Further, in this embodiment, the key slot can be configured to be at a 90 degree perpendicular to the keyhole on the padlock. This requires a person to insert the key through the key slot and then turn the key 90 degrees in order to unlock the padlock. This need to turn the key 90 degrees to access the keyhole of the padlock would not be visible to a person attempting to pick the lock.

Figure 16:
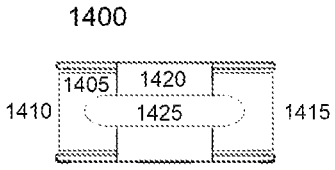
FIG. 16 is a bottom view of an inner sleeve component of an enclosure embodiment with padlock.

As depicted in FIG. 16, a view of the top of the second inner sleeve component 1400 of an enclosure embodiment is provided with padlock inserted, is provided in order to show the padlock inside of the enclosure. The padlock 1405 is inserted through the opening at either the left 1410 of right 1415 side of the enclosure. The padlock is shown latched such that the top 1420 of the inner sleeve component fits between the pad lock shackle legs 1425. The lock is secured in the enclosure while it is latched.

Figure 17:
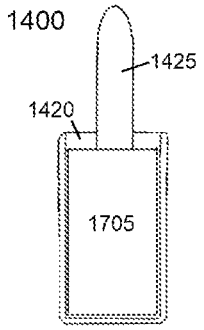
FIG. 17 is a side view of an inner sleeve component of an enclosure embodiment with padlock.

As depicted in FIG. 17, a view of the side of the second inner sleeve component 1400 of an enclosure embodiment is provided with padlock inserted, is provided in order to show the padlock inside of the enclosure. The padlock 1405 is visible through the opening on the side of the enclosure. The top side 1420 of the enclosure is obscured by the near shackle leg 1425, as the shackle has been secured so that the top side of the enclosure is between the 2 shackle legs.

Figure 18:
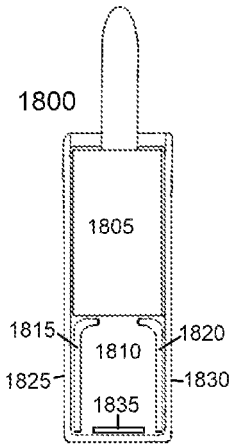
FIG. 18 is a side view of an inner sleeve component of an enclosure embodiment with padlock.

As depicted in FIG. 18, a view of the side of the second inner sleeve component 1800 of an alternative enclosure embodiment with padlock inserted, is provided in order to show the padlock inside of the enclosure. The inner sleeve component is taller than the padlock 1805 resulting in space 1810 between the bottom of the padlock and the bottom of the enclosure. In the depicted embodiment, support rails 1815, 1820 have been attached to the front 1825 and back 1830 sides of the enclosure. The support rails 1815, 1820 guide and support the padlock 1805 during insertion. Further, the depicted embodiment includes a neodymium magnet 1835 affixed to the enclosure bottom internally. The magnet would naturally attract to bottom side of an embodiment made from steel. This magnet is positioned next to or on top of the key slot, though the preferred embodiment is for a circular washer shaped magnet to surround the key slot opening. If a person attempts to pick the lock, the neodymium magnet 1835 will attract the picking tools and prevent picking or reduce control of the tools. Since, picking tools include bobby pins, safety pins, and paperclips, the neodymium magnet will similarly attract these tools. A key made out of brass or one that is sufficiently sturdy will not be thwarted by the neodymium magnet.

Figure 19:
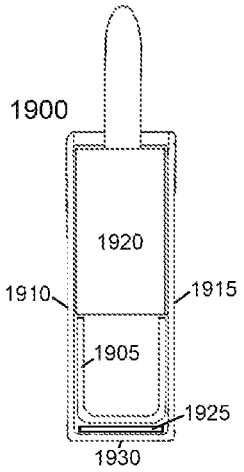
FIG. 19 is a side view of an inner sleeve component of an enclosure embodiment with padlock.

As depicted in FIG. 19, a view of the side of the second inner sleeve component 1900 of an alternative enclosure embodiment is provided with padlock inserted, is provided in order to show the padlock inside of the enclosure. In the depicted embodiment a U shaped plate 1905 is attached to the front 1910 and back 1915 sides of the enclosure. This structure acts as support rails to aid in inserting and supporting the padlock 1920. Additionally, it can be used to press and secure an additional plate 1925 that can include a Neodymium magnet, a stationary key slot, or a rotating key slot. Because the bottom 1930 of the enclosure, in the preferred embodiment, will be made of a strong metal, the use of an additional plate may allow the manufacture of the key slot more easily.

Figure 20:
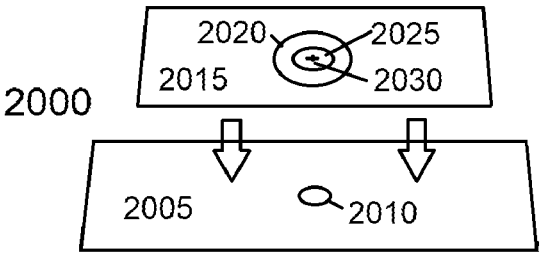
FIG. 20 is a bottom of the second inner sleeve component with internal plate of an enclosure embodiment

As depicted in FIG. 20, a bottom of the second inner sleeve component 2000 with internal plate of an enclosure embodiment is provided. The bottom 2005 side of the enclosure, which in the preferred embodiment is a strong metal, has had a small circle 2010 cut out of it. The internal plate 2015 has a larger circle cut out of it to allow the placement of a washer shaped neodymium magnet 2020 and a cobalt circle 2025 fitting having a key slot 2030. The cobalt fitting 2025 is able to rotate, thus causing the key slot 2030 to rotate. In other embodiments, the shape of such cuts could be square and would result in a stationary key slot. The internal plate 2015 can be secured to the bottom of the component as depicted in FIG. 19, using the U shaped plate 1905. The internal plate and key slot can be further supported and braced through various means to defend against a person trying to use a hole punch or some other tool on the key slot.

Figure 21:
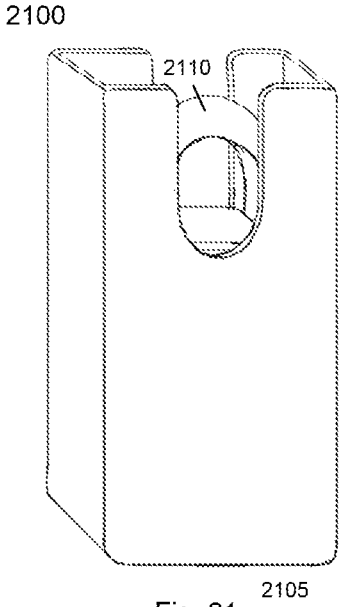
FIG. 21 is a perspective view of an enclosure embodiment.

Although the outer tube component and inner sleeve component can be used separate to improve the security of a padlock, the preferred embodiment uses the two components together to create a more effective padlock enclosure. As depicted in FIG. 21, a perspective view of an enclosure embodiment 2100 with padlock inserted, is provided in order to show the padlock inside of the enclosure. The padlock is first inserted in to the opening at either the left of right opening of the inner sleeve component. The padlock is position so that top of the inner sleeve component will be between the shackle legs when latched. The inner sleeve component (with padlock contained within) is then inserted into the opening at the bottom 2105 of the outer tube component. The padlock is inserted until the lock body encounters one or more stoppers that prevent any further insertion. The narrower shackle 2110 is able to continue past the stoppers where it is accessible for the purpose of latching to an object. Once latched, the padlock and inner sleeve component will not be able to fall out the bottom of the enclosure. The left and right sides of the outer tube component encloses the left and right openings of the inner sleeve component. The bottom side of the inner sleeve component seals the bottom opening of the outer tube component.

Figure 22:
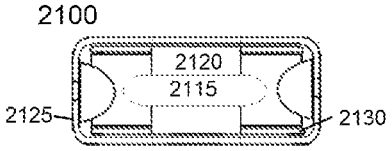
FIG. 22 is a top view of an outer tube component of an enclosure embodiment with padlock.

As depicted in FIG. 22, a view of the top of an enclosure embodiment 2100 with padlock inserted, is provided in order to show the padlock inside of the enclosure. The padlock 2115 is positioned such that the top 2120 of the inner sleeve component fits between the padlock shackle legs. When both components are combined, the only remaining opening at the top of the enclosure in order to access the padlock shackle for the purpose of latching. The hole in the bottom of the outer tube component 2125 should be slightly larger than the inner sleeve component 2130 to allow for the inner sleeve component to be inserted comfortably while not being able to rotate within. The left and right openings of the inner sleeve component, once inside the outer tube component, are no longer accessible.

Figure 23:
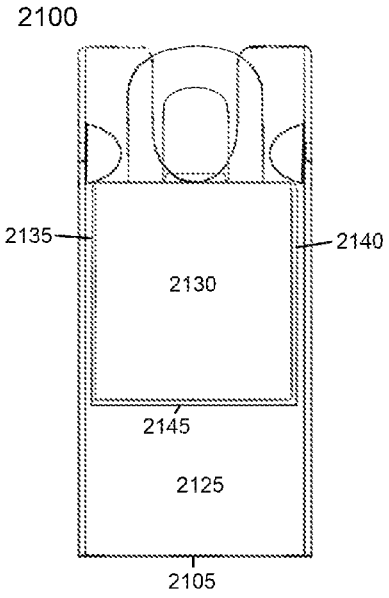
FIG. 23 is a vertical slice of the front of an enclosure embodiment with padlock.

As illustrated in FIG. 23, a vertical slice of the front of an enclosure embodiment 2100 with padlock inserted, is provided in order to show the padlock inside of the enclosure. The padlock was first inserted into the inner sleeve component through one of the side openings 2135, 2140. The inner sleeve component 2130(with padlock contained within) is then inserted into the opening at the bottom 2105 of the outer tube component 2125. The opening of the outer tube component, once the inner sleeve component is inserted, is no longer accessible. The bottom 2145 of the inner sleeve component prevents access to the padlock except by the key slot.

Figure 24:
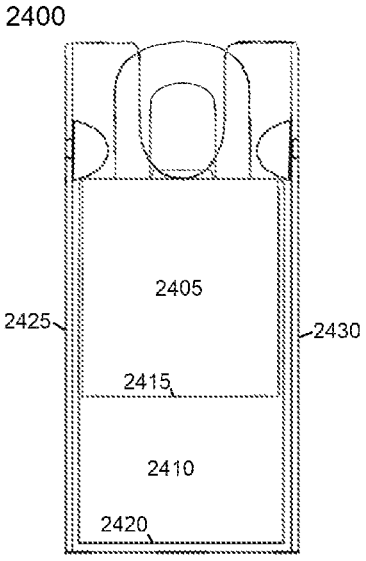
FIG. 24 is a vertical slice of the front of an enclosure embodiment with padlock.

As illustrated in FIG. 24, a vertical slice of the front of an alternative enclosure embodiment 2400 with padlock inserted, is provided in order to show the padlock inside of the enclosure. In the alternative embodiment, the inner sleeve component 2405 is significantly taller than the lock, such that there is empty space 2410 between the bottom 2415 of the padlock and the bottom 2420 of the enclosure. The left 2425 and right 2430 sides of the outer tube component encloses the left and right openings of the inner sleeve component. The bottom side 2420 of the inner sleeve component seals the bottom opening of the outer tube component. This enclosed empty space 2410 can now become a space for storage of small items, such as a folded up money, a key or a key fob. The alternatives such as leaving something under a mat, or fake rock vastly less secure. The enclosure not only improves the security of the padlock and what the lock is latched to, but also adds a new secure compartment.

Figure 25:
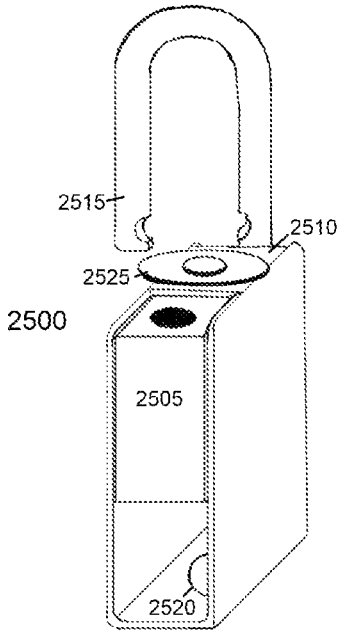
FIG. 25 is a perspective view of an inner sleeve component of an enclosure embodiment with padlock.

As illustrated in FIG. 25, a perspective view of the second inner sleeve component 2500 of an enclosure embodiment with padlock inserted, is provided in order to show the padlock inside of the enclosure. The padlock 2505 is inserted until it contacts the top 2510 of the inner sleeve component. The depicted swinging shackle 2515 can be latched, such that the top 2510 of the inner sleeve component is between the two shackle legs and the padlock 2505 cannot be removed. At the bottom of the enclosure, a neodymium magnet 2520 washer has been attached to attract any metallic picking tools, such as paper clips, bobby pins, and safety pins, which may be used to pick the lock. In the depicted embodiment, a securement mechanism 2525 has been attached to top of the inner sleeve component. As depicted, the securement mechanism 2525 is an oblong piece of metal that is secured to the top of the inner sleeve component. In the present position, the securement mechanism 2525 extends over the front and back sides of the inner sleeve component. In this position, the securement mechanism 2525 prevents the inner sleeve component from falling out the bottom of the outer tube component. The securement mechanism is able to rotate so that it is entirely above the inner sleeve component.

Figure 26:
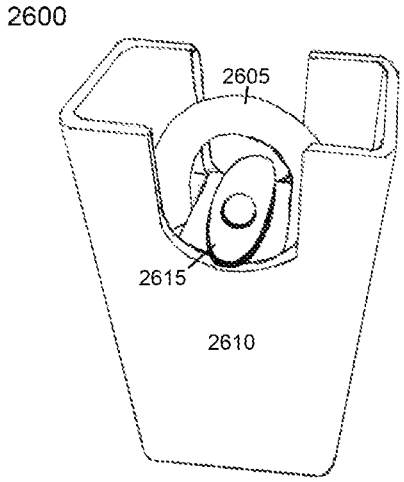
FIG. 26 is a perspective view of an enclosure embodiment with padlock.

As illustrated in FIG. 26, a perspective view of a padlock enclosure embodiment 2600 with padlock inserted, is provided in order to show the padlock inside of the enclosure. The padlock 2605 is shown inserted inside of the inner sleeve component, which is in turn inside of the outer tube component 2610. The securement mechanism 2615 has been rotated so that it extends over the front of inner sleeve component and over the front of the outer tube component. In this position, the securement mechanism 2615 prevents the inner sleeve component from falling out the bottom of the outer tube component as it is supported by the front and back sides of the outer tube component.

This disclosure also contemplates using some of the features discussed herein to make improvements to padlocks. An outer tube component could be affixed, through welding or other means, to the bottom of a padlock. The tube at increased lengths increases the difficulty of picking the padlock. This length ultimately requires a key, made longer by extending the handle, or requires a tool, such as a wand or forceps that is able to grasp the key to access the keyhole of the padlock. While an owner of the enclosure and padlock would invariably carry, have access to, or have knowledge of the whereabouts of such a key (an owner knows when they intend to open a lock), it would be less likely that a lock picker would carry tools of the necessary length.

Figure 27:
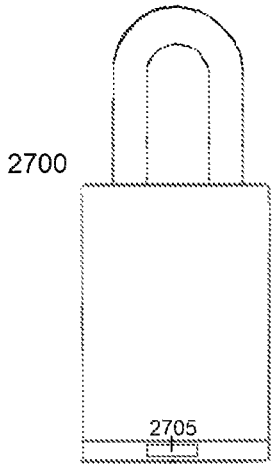
FIG. 27 is a front view of a padlock having a neodymium magnet.

As depicted in FIG. 27, neodymium magnet can be added to the bottom of a padlock 2700 to prevent access to the keyhole by picking tools that the neodymium magnet 2705 will attract, thus preventing access to the keyhole except using the key. This can be done by adding a plate that can be affixed, through welding or other means, to the bottom of the padlock. Similar to as described in FIGS. 19 and 20, such a plate could have a circular cutout or a key slot allowing access to the keyhole and could house a neodymium magnet of varying shapes though a washer is preferred. Such a plate containing a neodymium magnet washer would not add a significant amount of length to a padlock. Alternatively, the padlock housing can be made longer in order to house a neodymium magnet, of varying shapes though a washer is preferred. If necessary, a material able to absorb the magnetism of the neodymium magnet, to prevent the magnet from affecting the pins of the padlock, can be configured between the magnet and the locking mechanism. Adding a key slot to the base of the padlock of would require a key configured to access the keyhole through the key slot.

The preceding description contains embodiments of the invention and no limitation of the scope is thereby intended. It will be further apparent to those skilled in the art that various modifications and variations can be made in the present invention without departing from the spirit or scope of the invention.

The invention claimed is:

1. An enclosure for protecting a padlock, the padlock having a body, a shackle and a keyhole, said enclosure comprising:

a sleeve component having:

four walls: top, bottom, front and back;

openings at the left and right for receiving the padlock;

cutouts at the top to access the shackle holes;

a key slot limiting accessing to the keyhole except by a key;

the height of the sleeve component such that the distance between top and bottom of the enclosure is greater than the height of the padlock body resulting in an internal empty space between the bottom of padlock and the bottom of the sleeve component, wherein the sleeve component containing the padlock is inserted into a tubular component;

the tubular component having:

four walls: front, back, left and right;

an opening at the bottom for receiving the padlock;

an opening at the top for accessing the shackle;

one or more stoppers, extending from the walls of the enclosure internally, capable of contacting the body of the padlock preventing further insertion of the padlock, while allowing a shackle in any position to continue past;

a cutout on the front and back walls of the enclosure beginning at the stoppers and proceeding upward;

the height of the tubular component such that the tubular component fully contains the sleeve component.

2. The enclosure of claim 1 further comprising:

the sleeve component having:

a securement mechanism at the top to prevent the padlock from falling through the opening at the bottom of the tubular component.

3. The enclosure of claim 1, wherein the tubular component cutout is asymmetrically cut to allow for a swinging shackle to swing outward.

4. The enclosure of claim 1, wherein the sleeve component key slot can rotate.

5. The enclosure of claim 1, wherein the containing of the sleeve component within the tubular component creates a storage compartment within the enclosure below the padlock.

6. The enclosure of claim 1, wherein the key slot is configured to be at a 90 degree perpendicular to the keyhole on the padlock.

7. The enclosure of claim 1 further comprising:

the sleeve component having:

a neodymium magnet internally affixed to the bottom.

8. A tubular enclosure for protecting a padlock, the padlock having a body, a shackle and a keyhole, said enclosure comprising:

four walls: front, back, left and right;

an opening at the bottom for receiving the padlock;

an opening at the top for accessing the shackle;

one or more stoppers, extending from the inside walls of the enclosure, whereby the stoppers are configured to contact the top of the body of the padlock preventing further insertion, such that the body of the padlock remains below the one or more stoppers, while the space between the stoppers allows the shackle of the padlock in any position to pass between the stoppers;

a cutout on the front and back walls of the enclosure beginning at the stoppers and proceeding upward.

9. The tubular enclosure of claim 8 further comprising:

a securement mechanism at or near the opening at the bottom to prevent the padlock from falling through the opening at the bottom.

10. The tubular enclosure of claim 8, wherein the height of the enclosure is such that the distance between the stoppers and the opening at the bottom is greater than the height of the padlock body.

11. The tubular enclosure of claim 8, wherein the cutout is asymmetrically cut to allow for a swinging shackle to swing outward.

* * * * *